US007695409B2

(12) United States Patent
Helie et al.

(10) Patent No.: US 7,695,409 B2
(45) Date of Patent: Apr. 13, 2010

(54) SELF-POWERED RUNNING MACHINE WHICH CAN BE FOLDED IN ORDER TO OCCUPY LESS SPACE

(75) Inventors: Christophe Helie, Ronchin (FR); Serge Ekeloo, Houplines (FR); Grégoire Nys, Lesquin (FR); Nicolas Allion, Haumont (FR); Christophe Marcy, Haumont (FR)

(73) Assignee: Decathlon, Villeneuve d'Ascq (FR)

( * ) Notice: Subject to any disclaimer, the term of this patent is extended or adjusted under 35 U.S.C. 154(b) by 188 days.

(21) Appl. No.: 11/795,414

(22) PCT Filed: Jan. 17, 2006

(86) PCT No.: PCT/FR2006/000101

§ 371 (c)(1),
(2), (4) Date: Oct. 26, 2007

(87) PCT Pub. No.: WO2006/075110

PCT Pub. Date: Jul. 20, 2006

(65) Prior Publication Data

US 2008/0132386 A1 Jun. 5, 2008

(30) Foreign Application Priority Data

Jan. 17, 2005 (FR) ..... 05 00479

(51) Int. Cl.
*A63B 22/02* (2006.01)
*A63B 23/00* (2006.01)

(52) U.S. Cl. ..... 482/54; 482/148

(58) Field of Classification Search ..... 482/51, 482/54, 148, 908, 910
See application file for complete search history.

(56) References Cited

U.S. PATENT DOCUMENTS

| | | | | |
|---|---|---|---|---|
| 4,738,340 | A * | 4/1988 | Crespi | 190/18 R |
| 5,480,365 | A * | 1/1996 | Lundin et al. | 482/53 |
| 6,077,200 | A | 6/2000 | Lin | |
| 6,189,846 | B1 | 2/2001 | Wang | |
| 6,383,120 | B1 | 5/2002 | Lo | |

(Continued)

FOREIGN PATENT DOCUMENTS

EP 1 304 143 A1 4/2003

*Primary Examiner*—Steve R Crow
(74) *Attorney, Agent, or Firm*—Kenyon & Kenyon LLP

(57) ABSTRACT

An independent and foldable running exercise installation that includes: a platform that includes a chassis and, incorporated into the latter, a running track and its tensioning and driving means fixed to the front of the platform, two lateral uprights the top ends of which support a handlebar that includes two lateral branches connected by a linking part, and the ends of which act as handles. Each lateral upright is formed of a front arm and a rear arm which are in parallel and articulated by their lower ends on the side of the platform, on two pivoting axes, and by their top ends to the lateral branches on two pivoting axes. Since the first axis is higher than the second, the four axes forming a deformable parallelogram between a position of use in which the handgrips are more or less horizontal and the lateral uprights are more or less vertical, and a storage position in which the linking part is placed flat on the top of the platform and the lateral uprights on the sides of the platform. The installation includes removable means for locking the lateral uprights at least in the position of use.

11 Claims, 7 Drawing Sheets

U.S. PATENT DOCUMENTS 6,387,016 B1 * 5/2002 Lo ..... 482/54
6,602,167 B2 * 8/2003 Chen ..... 482/54
2002/0142891 A1 10/2002 Chen
2003/0060331 A1 3/2003 Polk
2004/0116255 A1 6/2004 Chen

* cited by examiner

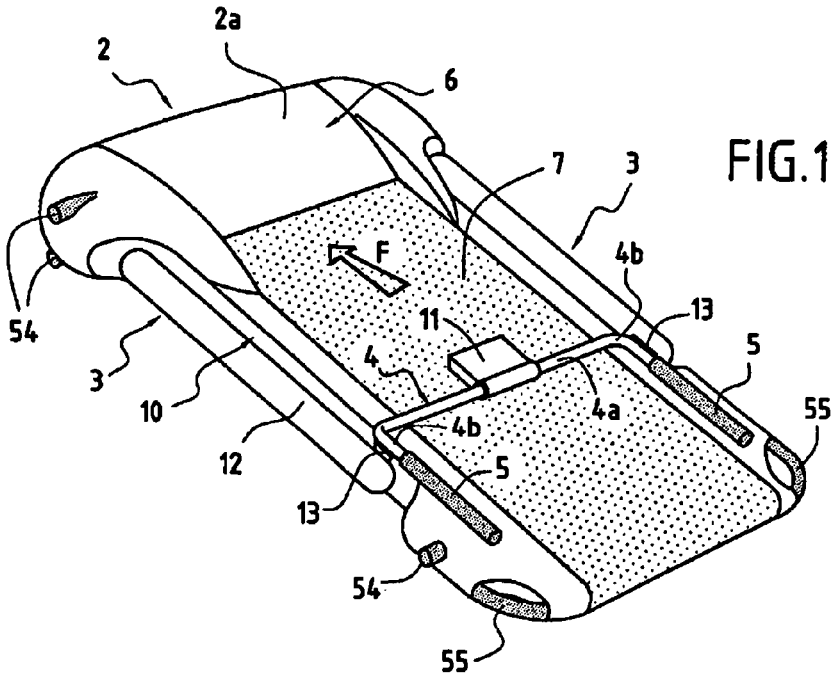
FIG.1
FIG.4
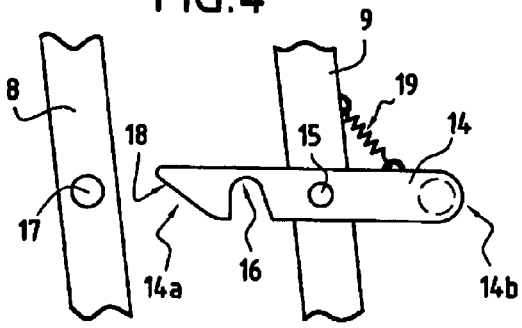
FIG.5
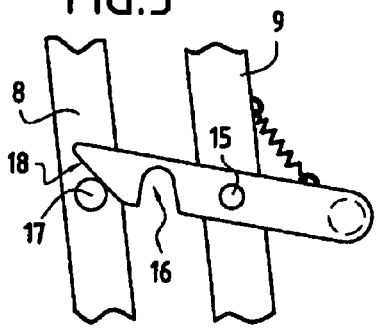
FIG.6
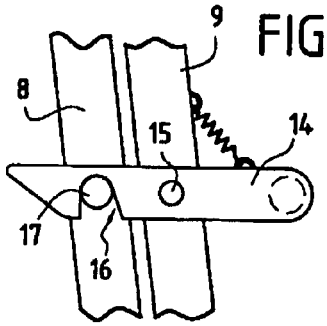
FIG.7
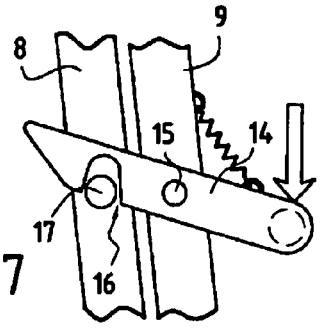

FIG.8
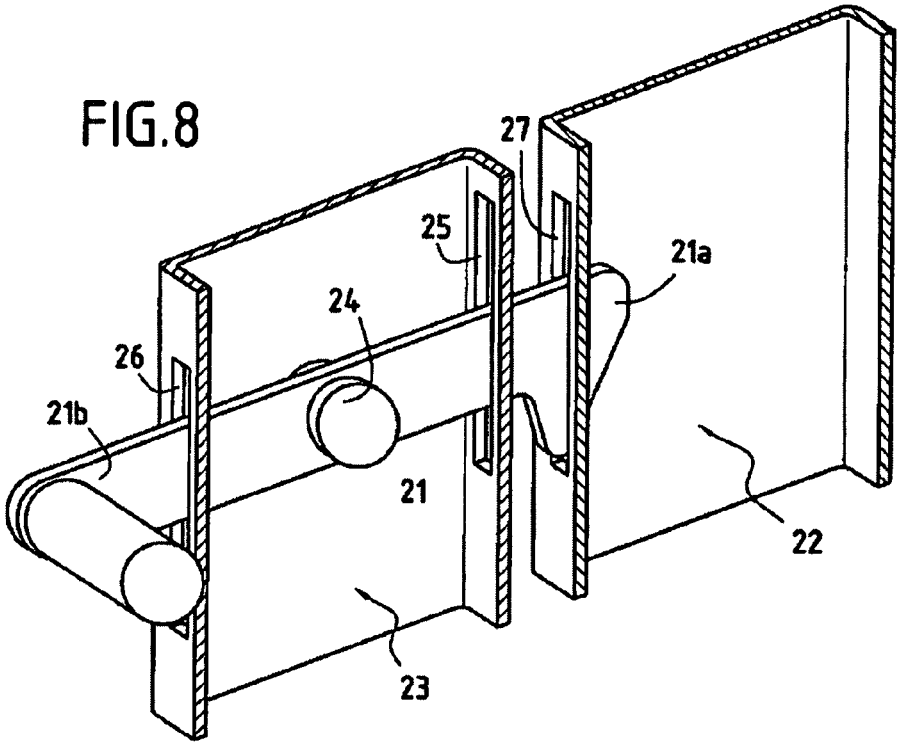
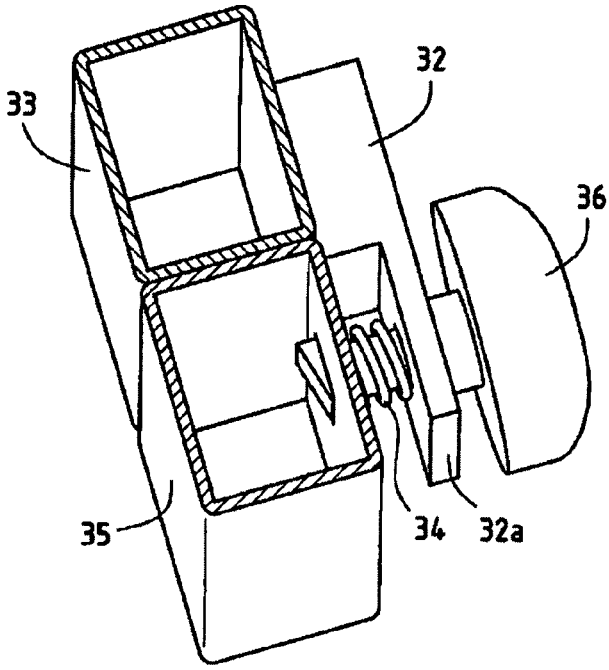
FIG.12

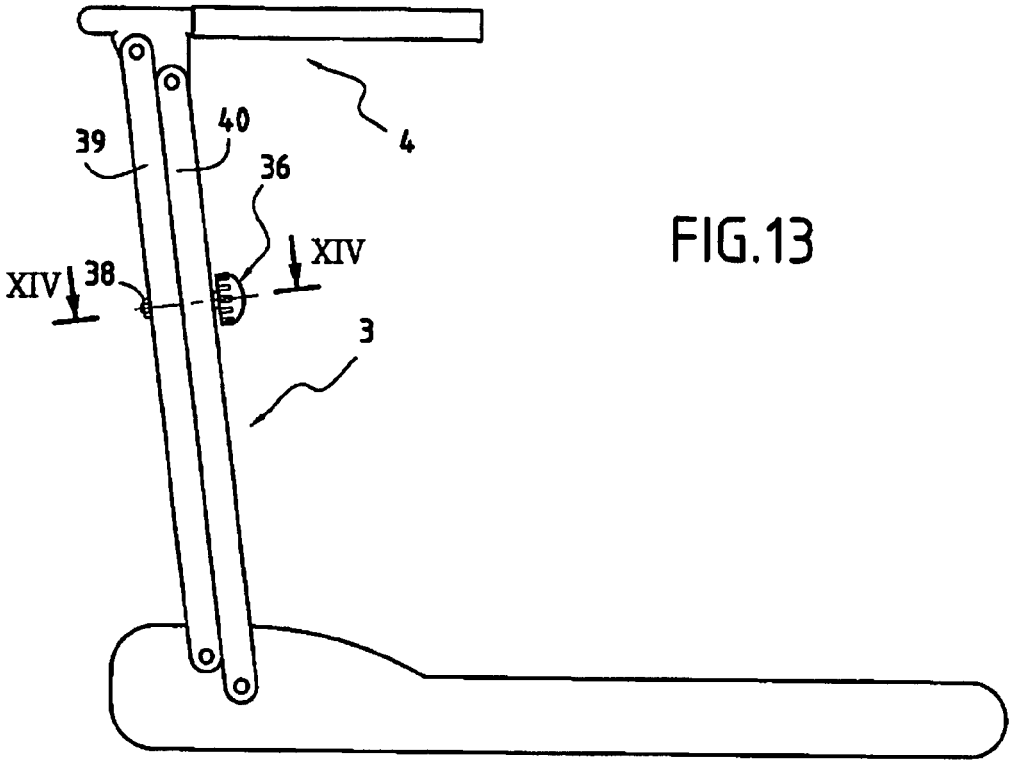
FIG.13
FIG.14
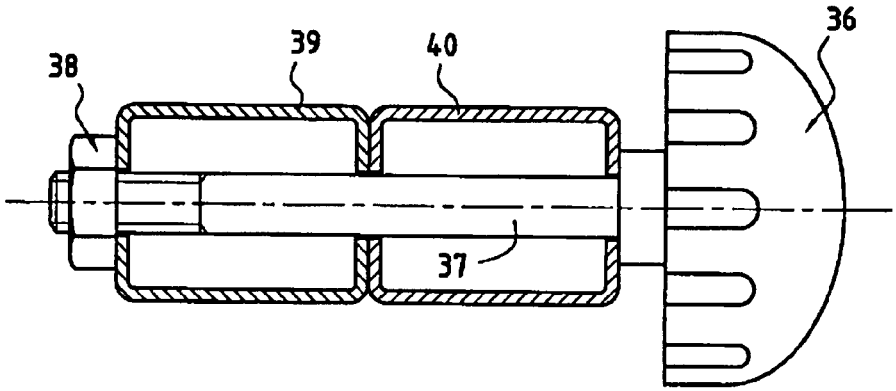

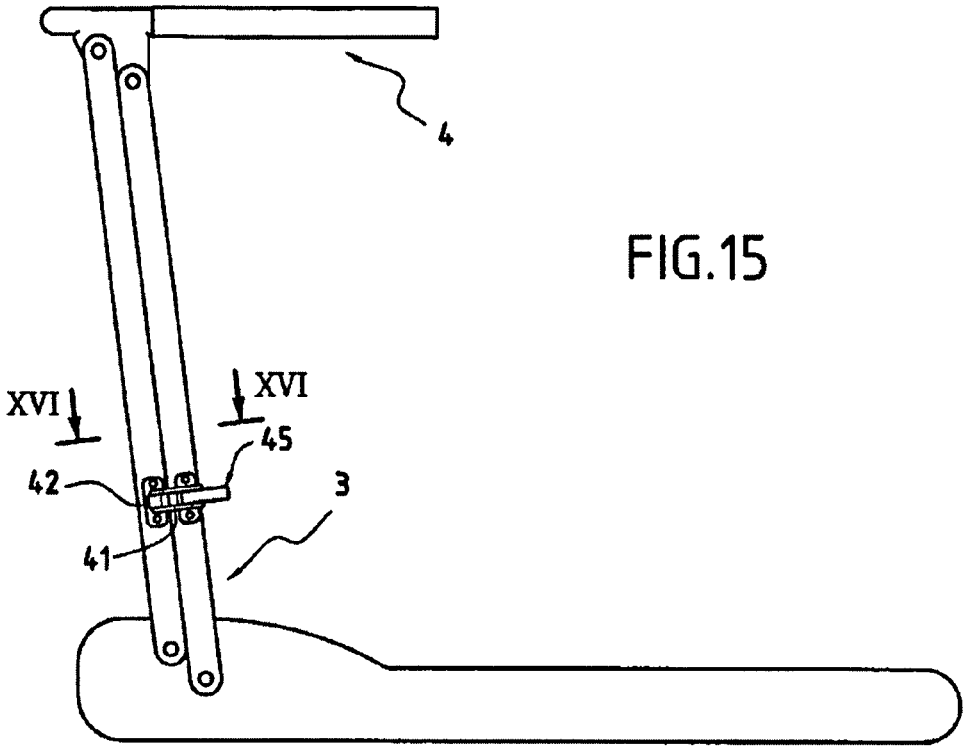
FIG.15
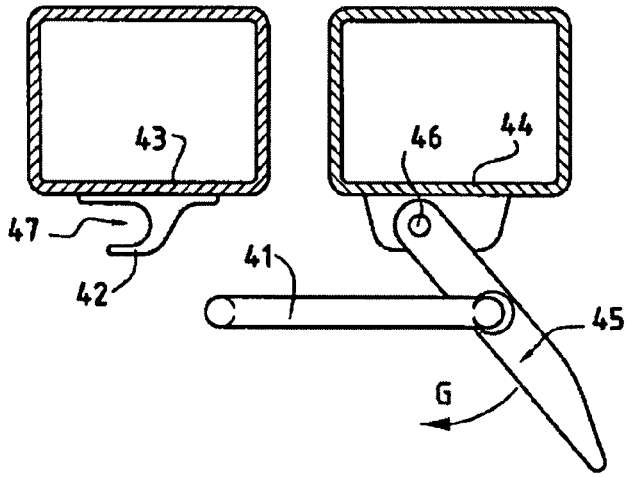
FIG.16
FIG.17
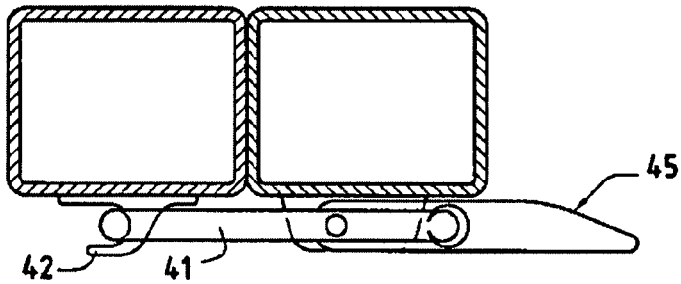

SELF-POWERED RUNNING MACHINE WHICH CAN BE FOLDED IN ORDER TO OCCUPY LESS SPACE

CROSS-REFERENCE TO RELATED APPLICATIONS

This is a 371 national phase application of PCT/FR2006/000101 filed 17 Jan. 2006, claiming priority to French Patent Application No. FR 0500479 filed 17 Jan. 2005, the contents of which are incorporated herein by reference.

TECHNICAL FIELD

The present invention concerns the area of physical exercise appliances, such as, for example, athletes. More particularly, it concerns an independent running installation, such as an installation in which a running track, stretched between cylinders, is driven so that it moves at a variable speed, and so that the user can move on the track at a walking or running pace to match the speed of movement of the track.

BACKGROUND

Documents U.S. Pat. No. 6,077,200, U.S. Pat. No. 6,602,167 and EP 1 304 143 describe installations of this type which can be easily folded and stored. In each of these three documents however, it is specified that in the folded position, the installation rests on a base that occupies a space of reduced size on the ground, with the running track in a vertical or substantially vertical position. It can be seen that since the base is not sufficiently broad, there is a risk of toppling the installation in the event of an impact. In addition, storage in the vertical position is not very aesthetic, in particular when it is physically located in a user's home.

In the known installations, in particular those in the aforementioned documents, the user has the ability to support himself/herself on support means (e.g., handlebars facing the user). This can be a U-shaped handlebar whose lateral branches extend down to the ground (EP 1 304 143), or a U-shaped handlebar in which the ends of the lateral branches act as handles (U.S. Pat. No. 6,602,167), or a U-shaped handrail (EP 1 304 143).

BRIEF SUMMARY

The primary purpose of the present invention is to provide a foldable running installation, whose holding means consist of a handlebar with two lateral branches whose ends act as handles that overcome the aforementioned drawbacks, in that, in the folded position, it can occupy the smallest space possible, either with a flat arrangement, with the running track being more-or-less horizontal, or an edgewise arrangement, with the running track being more-or-less vertical, preferably resting against a support structure, such as a wall or a partition, for example.

This objective is attained by the independent and foldable running exercise installation of this present invention, which includes the following known features:

a a platform with a running track and means for switching on and driving the said running track, b two lateral uprights, whose top ends support a handlebar with two handgrips, fixed to the front of the platform, c the handlebar 4, in particular in the shape of a U, includes two lateral branches 4*b* connected to each other by a linking part, with the ends of the two said lateral branches acting as handgrips 5, and d each of the two lateral uprights is formed from two arms, namely a front arm and a rear arm respectively, that are close to each other, parallel and articulated by their lower ends on the side of the platform on first and second pivoting axes, and by their top ends to the lateral branches of the handlebar on third and fourth pivoting axes, in such a manner that the four axes form a parallelogram that is deformable between a position of use in which the handgrips are more-or-less horizontal and the lateral uprights are more-or-less vertical and preferably inclined toward the front of the platform, and a storage position in which the linking part of the handlebar is placed flat on the top of the platform and the lateral uprights are located on the sides of the platform.

Preferably, the first (A) and the second (B) pivoting axes are offset in height in relation to each other, with the first (A) being higher than the second (B).

Also preferably, the installation includes removable means for locking the lateral uprights at least in the position of use.

According to an implementation variant, in the position of use, the rear arm of each lateral upright rests against the front arm of the same upright, with a slope toward the front of the platform at an angle $\alpha$ of the order of 5 to 15°, and preferably 10°. The advantage of this variant is that it prevents any deformation of the deformable parallelogram under the effect of a vertical force that may be exerted by the user on the two lateral branches of the handlebar. In fact in this case, the force induced on the rear arm of each upright, which tends to push the said arm to the front of the platform, has no negative effect since the said rear arm is already resting on the front arm.

According to an implementation variant, the means for temporary locking of the lateral uprights in the first position of use include, for each lateral upright, a first locking element that is attached to a given arm and that is designed to come in contact in a reversible manner with the other arm, or with a second locking element attached to the other arm. On the basis of this variant, many methods of implementation can be designed, as will appear in the examples described below.

In an implementation variant, the two arms of a given lateral upright are enveloped, totally or partially, by a sheath, thus preventing any pinching of the user's fingers, in particular during passage from the position of use to the storage position, and vice versa. In particular, this sheath can be a sleeve of elastic fabric or an enclosure made from a plastic material.

In an implementation variant, the installation includes protective boots or bellows surrounding at least the end portions of the two lateral uprights so as to cover the zone of tie pivoting axes of the two front and rear arms. The presence of these protective boots also aims to prevent the trapping of the user's fingers.

In an implementation variant, the installation includes means for detecting the position of use, which are connected to the means for driving the running track and designed to enable the actuation of the driving means only when the detection means detect that the uprights are in the said position of use.

According to one method of implementation, the detection means include two devices, one being fixed onto one of the arms of a lateral upright and the other onto the other arm of the same lateral upright, where these two devices are in contact when the two arms of the same upright rest against each other in the position of use, and are apart from each other in all other position.

In an implementation variant, the installation includes support feet on at least one side of the platform, together forming a stable base area when the installation is placed edgewise on the said side in the storage position.

In an implementation variant, the installation includes carrying handles, formed at the rear of the platform and by transportation rollers placed so as to project from the front face of the platform.

In an implementation variant, the installation includes a control and read-out panel, mounted on the transverse portion of the handlebar with a mounting such that in the storage position, the said panel is placed flat on the top of the platform.

In another variant, the control and read-out panel is incorporated into the front part of the platform. In relation to the previous one, this method of implementation has the advantage of avoiding the installation of electrical connecting means between the handlebar and the electrical power source, which is located at the motor.

This present invention will be understood more clearly on reading the description that follows of examples of implementation of a foldable independent installation for running exercise, whose folding system is based on an articulated assembly in a deformable parallelogram, as illustrated in the appended drawings in which:

BRIEF DESCRIPTION OF THE DRAWINGS

FIG. 1 is a view in perspective of an installation in the flat storage position, FIGS. 4 to 7 illustrate the locking and unlocking stages of the temporary locking means according to the first method of implementation of the installation of FIG. 3, FIG. 8 illustrates a second method of implementation of temporary locking means, FIG. 12 illustrates a fourth method of implementation of the temporary locking means, FIG. 13 is a schematic side view of an installation equipped with a fifth method of implementation of the temporary locking means, FIG. 14 is a view in section of the installation of FIG. 13 on axis XIV-XIV, FIG. 15 is a schematic side view of an installation equipped with a sixth method of implementation of the temporary locking means, FIGS. 16 and 17 illustrate the implementation of temporary locking means according to this sixth method of implementation, before locking (FIG. 16) and after locking (FIG. 17)

DETAILED DESCRIPTION

Figure 2:
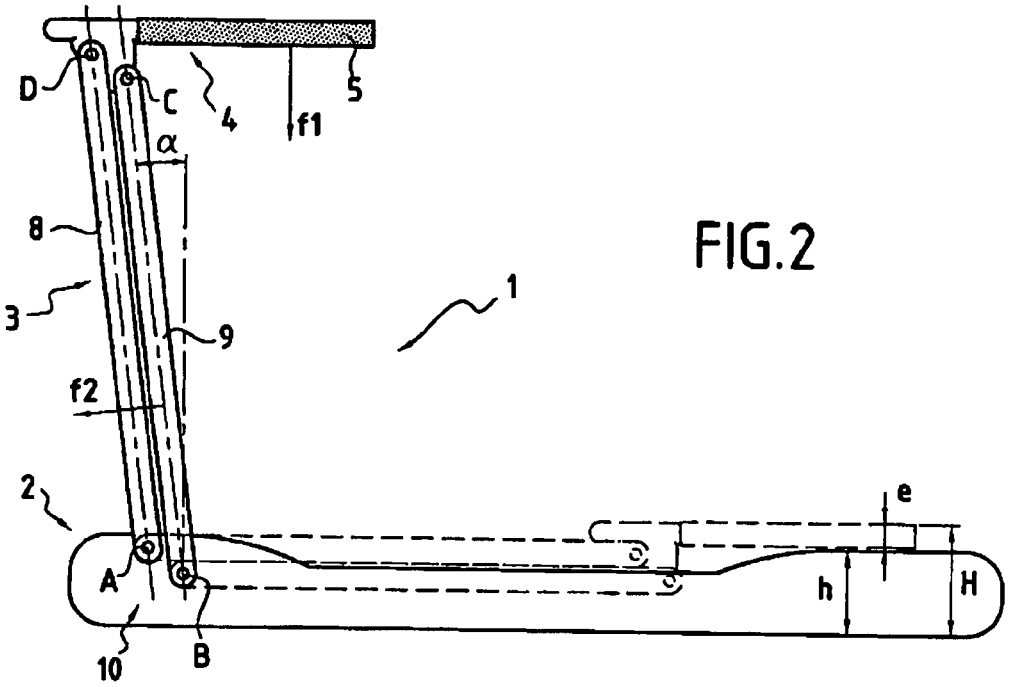
FIG. 2 is a schematic side view illustrating the deformable parallelogram and its passage from the position of use to the storage position (broken lines)

This installation 1 includes a platform 2 and two lateral uprights 3 whose top ends support a handlebar 4 with two handgrips 5.

The platform 2 includes a chassis covered by an enclosure 6 and, incorporated into the latter, a strip or belt 7, generally called a running track, as well as means for tensioning and driving the running track. In FIG. 1, the tensioning means, in particular the cylinders on which the running track is stretched, as well as the driving means and in particular the motor and its control means, are not visible, being located under the enclosure or cowling. Only the top part 7 of the running track is visible, constituting the central and active part of the platform 2.

The handlebar 4 is in the shape of a U in which the ends of the two lateral branches act as handles 5, being in particular covered with a foam or elastomer sheath.

As can be seen in greater detail in FIG. 2, each of the two lateral uprights 3 is formed from two arms, namely a front arm 8 and a rear arm 9, respectively. The concept of front and rear are determined with reference to the usual direction of movement of the running track 7 in the installation 1, as shown by the arrow F. The two front 8 and rear 9 arms are close to each other, being parallel and articulated to pivot firstly by their lower ends on the side 10 of the platform 2 on a first pivoting axis A for the front arm 8 and a second pivoting axis B for the rear arm 9, and secondly by their top ends to the lateral branches of the handlebar 4 on a third pivoting axis D for the front arm 8 and a fourth pivoting axis C for the rear arm 9. The first axis (A) and the second axis (B) are offset in height in relation to each other, with the first axis (A) being at a higher level in relation to the second axis (B). These four pivoting axes A, B, C, D and the elements that connect them constitute a deformable parallelogram deformable between a position of use and a storage position, which are illustrated in FIG. 2, as a solid line for the position of use and a broken line for the storage position.

In the position of use, the handgrips 5 are more-or-less horizontal and the lateral uprights 3 are more-or-less vertical. As will be explained below, it is desirable that the vertical uprights should be slightly inclined toward the front at an angle $\alpha$ of between 5 and 15°, and preferably 10° as illustrated in FIG. 2.

In the storage position, the transverse portion 4*a* of the handlebar 4 is placed flat on the top of the platform 2, which here is on the top part of the running track 7, and the lateral uprights 3 are located on the sides 10 of the platform 2. In the storage arrangement of the lateral uprights 3, the two arms 8, 9 are superimposed along the side of the platform, with the front arm 8 being above the rear arm 9, due in particular, in this example, to the offset in height of the two axes A, B, specifies above.

In addition, the installation 1 includes removable means for locking the lateral uprights 3, designed to effect the locking of the said uprights 3 firstly in the position of use and secondly in the storage position, while also allowing the user to pass the uprights from one position to the other. In the example illustrated in FIG. 2, the handgrips 5 are strictly horizontal so that, in the storage position, they are also located above the top part of the running track 7. Thus the total height H of the installation 1 corresponds to the height h of the platform at the level of the top part of the running track 7 plus the thickness (e) of the handgrips 5. In the case where the handgrips 5 are not strictly horizontal but slightly sloping downwards, the thickness to be considered is not that of the handgrips but that of the transverse portion 4*a* of the handlebar 4, with the handgrips 5, for their part, preferably being located along the sides 10 of the platform 2.

In practice, as illustrated in FIG. 1, the actual height of the installation 1, in the folded position, can correspond to the part of the enclosure or cowling 6 that covers the motor and the different tensioning, driving and control devices of the running track 7. Thus the folding of the lateral uprights 3 and of the handlebar 4 causes no increase in dimensions in relation to the actual height of the enclosure or cowling 6.

In the example illustrated in FIG. 1, mounted on the transverse portion 4*a* of the handlebar 4 is a panel 11 for reading the different data concerning the current exercise and n particular the speed of movement of the running track 7, the distance covered, the duration of the exercise, etc. In this case, in order to comply with the required minimum size, the panel 11 is positioned in line with the handgrips 5 so that, in the folded position, the panel 11 is placed flat on the top part of the running track 7. If necessary, it could be arranged that the panel 11 can be pivoted around the transverse portion 4*a* of the handlebar 4 so that the user can incline it in order that the data displayed on the panel are more visible.

If necessary, the panel in question can purely and simply be incorporated into the enclosure or cowling 6, in particular in the front part 2*a* of the platform, which is located ahead of the running track 7. This method of implementation has the advantage of simplifying the electrical connection to the motor, which is located under the enclosure or cowling in question.

As indicated above, the front arm 8 and the rear arm 9 of a given lateral upright 3 are close to each other and in parallel. In a preferred method of implementation, which is illustrated in FIG. 2, in the position of use, the lateral uprights 3 and therefore the two arms 8, 9 are slightly inclined toward the front and, in addition, the rear arm 9 is resting against the front arm 8 of the same upright 3. This particular arrangement is used to achieve self-locking of the two arms 8, 9 in the position of use, whatever the bearing force applied by the user on the handgrips 5, without which it would be necessary to install removable locking means that are particularly strong from the mechanical viewpoint. In fact the force $f_1$ exerted by the user when he/she bears onto the handgrips 5 is reflected onto the rear arm 9 by a force $f_2$ that tends to push the rear arm 9 toward the front arm 8 and therefore deforms the parallelogram ABCD. In this present case, the force $f_2$ only contributes to the application of the rear arm 9 against the front arm 8, and no deformation of the parallelogram ABCD can occur.

In the example illustrated in FIG. 2, here again the two arms 8, 9 are applied against each other when the installation 1 is in its storage position.

It should be noted that in all the intermediate positions between those of use and of storage as illustrated in FIG. 2, the two arms 8, 9 have a certain distance between them that increases as a function of the angular separation between these two extreme positions. The presence of this separation can comprise a risk for the user, when the user is handling the installation with a view to its use or its storage, due to the fact that he can possibly trap a finger during this operation. In order to overcome this drawback, the two arms 8, 9 of each lateral upright 3 are preferably enveloped in a protective sheath 12, which closes off at least the spaces that are accessible between the two arms 8, 9. This can be a sleeve of elastic fabric that is slid around the two arms during the assembly of the lateral upright or it can be an enclosure in a plastic material that has a longitudinal slot so that the sides of the enclosure or cowling can be separated and that the enclosure or cowling can be fitted around the arms 8, 9.

In addition, and again for the safety of the user during the manipulation of the installation 1, the lateral upright is preferably equipped with at least one boot or bellows that covers one or other of its ends, at the level of the pivoting axes A, B and/or C, D. This concerns the fixing of the handlebar 4 on the top ends of the front 8 and rear 9 arms, and this fixing can be accomplished directly on the lateral branches 4*b* of the handlebar 4 or indeed indirectly by means of an intermediate part 13. In the example illustrated in FIG. 1, the handlebar 4 has a tubular structure, with two elbow bends to form the lateral branches 4*b*. An intermediate part 13 is secured, if necessary by welding, onto the lateral branch 4*b*, between the handgrip 5 and the transverse portion 4*a* of the handlebar 4. It is on this intermediate part 13 that the pivoting axes C, D of the rear 9 and front 8 arms of the lateral upright 3 are fixed.

The removable means for locking the lateral uprights in the position of use and in the storage position can assume multiple forms. Several methods of implementation will be described below, with reference to FIGS. 3 to 17. Most of these methods of implementation have in common the fact that a first locking element attached to one of the arms of the lateral upright is designed to come in contact either directly with the other arm or with a second locking element itself attached to the second arm.

In the first method of implementation, illustrated in FIGS. 3 to 7, the removable locking means include, for each lateral upright 3, a locking part 14 of extended shape, whose central part is attached to the rear arm 9 by a pivoting axis 15. The front end 14*a* of this locking part 14 includes a notch 16, giving to this front end 14 the shape of a hook, which is designed to hook onto a cylindrical pin 17 fixed onto the front arm 8, in the position of use of the installation 1. In addition the front end 14*a* of the locking part 14 has a tapered head, with a portion inclined obliquely 18, whose technical purpose will appear more clearly in the remainder of the description.

The rear end 14*b* of the locking part 14 is connected to the rear arm 9 by a spring 19. The two locking parts 14 have their rear ends 14*b* connected to each other by a strut 20 which, in the example illustrated in FIG. 3, acts as a pedal for actuation of the removable locking means.

FIGS. 4 to 7 illustrate the operation of the said locking means.

Figure 3:
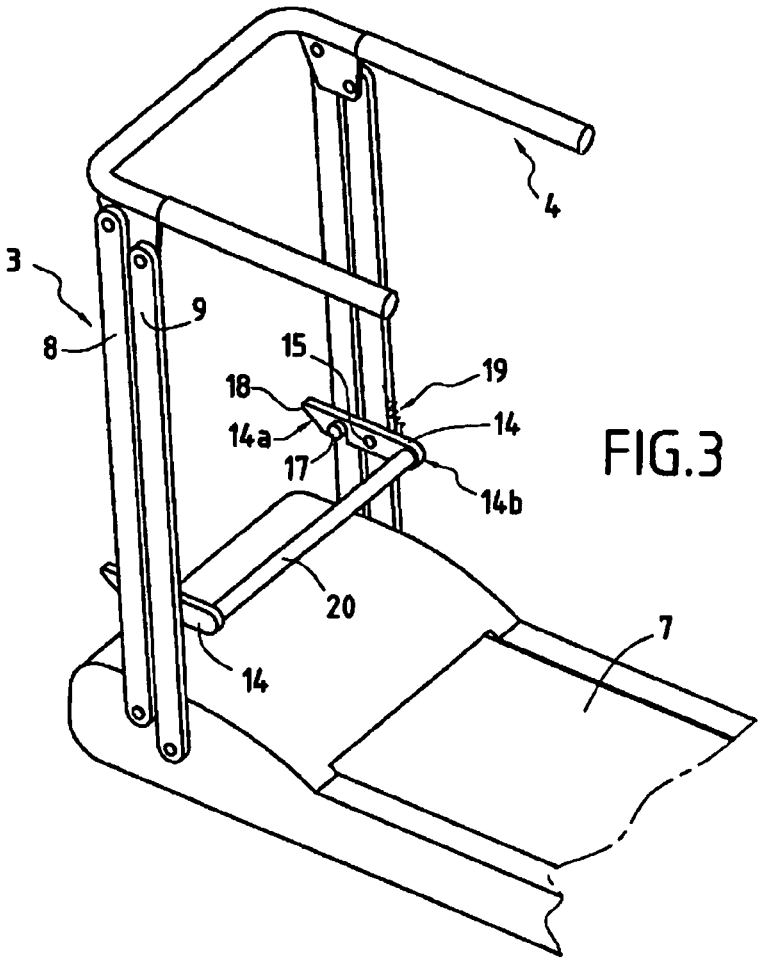
FIG. 3 is a schematic view in perspective of an installation with temporary locking means, according to a first method of implementation.

FIG. 4 schematically illustrates the placement of the front 8 and rear 9 arms when the user moves the lateral uprights and the handlebar from the storage position to the position of use, with the front 8 and rear 9 arms being distanced from each other. As the position of use is approached, the arms 8, 9 draw closer until the oblique portion 18 of the front end 14*a* of the locking part 14 comes to bear upon the surface of the cylindrical pin 17, thus constraining the piece 14 to pivot around its axis 15 (FIG. 5) until the cylindrical pin 17 reaches the notch 16. Under the effect of the return spring 19, the locking part 14 pivots in the reverse direction so that the locking part 14 is hooked onto the cylindrical pin 17, which remains locked in the notch 16. Thus, the position of use of the installation is attained (FIGS. 3 and 6). To pass from this position of use to the storage position, the user must release the cylindrical pin 17 from the notch 16 by pressing on the strut 20 (FIG. 7) and by moving the lateral uprights 3 to the rear.

The second method of implementation, illustrated in FIG. 8, differs from the first in that since the front 22 and rear 23 arms are in U-shaped channel, the locking part 21 is fixed so a to pivot around an axis 24 within the rear arm 23, while the front 21*a* and rear 21*b* ends of the said locking part 21 pass via through holes 25, 26 created in the front and rear faces of the rear arm 23. In addition, the rear face of the front arm 22 is itself pierced with a through hole 27 that, when the arms 22, 23 are in the position of use, are facing each other. Thus the locking position of the front 22 and rear 23 arms is achieved by entry of the front end 21*a* of the locking part 21 in the through hole 27 of the front arm 22 and by the pivoting of the locking part 21 around its axis 24 due to the action of the return spring.

Figure 9:
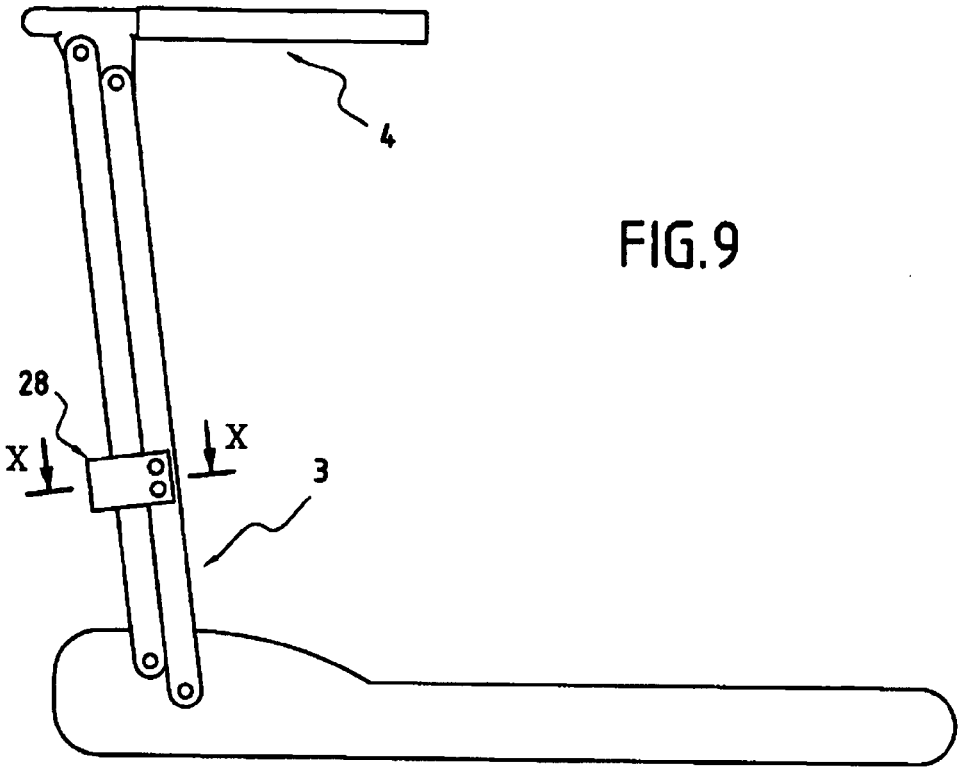
FIG. 9 is a schematic side view of an installation that includes a third method of implementation of the temporary locking means.
Figure 10:
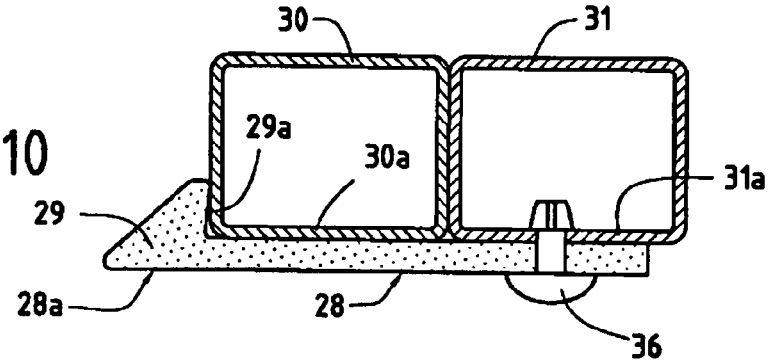
FIGS. 10 and 11 are views in section of the installation of FIG. 9, along the axis X-X in the locked position (FIG. 10) and in the unlocked position (FIG. 11)
Figure 11:
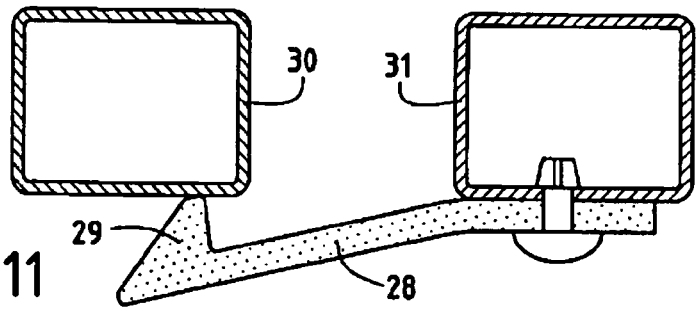

The third method of implementation, illustrated in FIGS. 9 to 11, employs a flexible locking tongue 20, whose front end 28*a* includes a projecting shoulder 29 designed to come in contact with the front face 30*a* of the front arm 30, when the installation is in the position of use. The two front 30 and rear 31 arms are of square or rectangular section. The rear end 28*b* of the tongue 28 is fixed on the lateral face 31*a* of the rear arm 31. The length of the tongue 28, between its fixing point and the shoulder 28 is determined so that, in the position of use, as illustrated in FIG. 6, the tongue 28 is resting against the lateral faces 30*a* and 31*a* of the front 30 and rear 31 arms while the shoulder 29 has its rectilinear rear part 29*a* in the immediate vicinity of the front face 30*a* of the front arm 30. Thus the two arms 30, 31 cannot separate due to the fact that the front arm 30 abuts up against the shoulder 29. In order to release the tongue, the user simply moves the shoulder 29 away from this position by slightly bending the tongue 28 as illustrated in FIG. 11. The shoulder 29 has an oblique portion which, during the approach of the two arms 30, 31, bears upon the rear face 30*b* of the front arm 30 and pushes the tongue 28 outwards until the front arm 30 has attained the position of use as illustrated in FIG. 10.

The fourth method of implementation, illustrated in FIG. 12, includes a locking latch 32 that is fixed to pivot on one of the two arms, such as the front arm 33, for example, and whose rear end 32*a* includes a notch not visible in FIG. 12 that is designed to come into contact with a pin 34 attached to the rear arm 35. The locking action of the latch 32 on the pin 34 can be effected by providing a button 36, as in the illustrated example, that can be screwed onto the threaded end of the pin 34.

The fifth method of implementation, illustrated in FIGS. 13 and 14, uses a knob 36 that includes an axial rod 37 whose threaded end 37*a* is designed to mate with a nut 38. The two front 39 and rear 40 arms have their front and rear faces pierced with through holes. The length of the rod 37 is such that when it is threaded into the through holes of the two arms butted against each other, in the position of use, the threaded end 37*a* is accessible. The nut 38 can be screwed on in such a manner that the two arms 39, 40 are locked against each other between firstly the nut 38 and secondly the knob 36.

The sixth method of implementation, which is illustrated in FIGS. 15 to 17, employs a locking loop 41 that is designed to latch onto a hook 42 fixed onto the front arm 43. This locking loop 41 is itself attached to the rear arm 44 using an operating lever 45 that is arranged to pivot on the rear arm 44 on a pivoting axis 46. FIG. 16 represents the stage preceding the locking in position of the two arms 43, 44, with the locking loop 41 being moved due to the pivoting of the lever 45 as shown by the arrow G around its axis 46 so that it engages in the throat 47 of the hook 42, oriented to the front of the front arm 43. Once the loop 41 is engaged in the said throat 47, the user just has to lower the lever 45 in order to pivot it in the reverse direction until the lever 45 drops down against the rear arm 44 thus locking the two arms 43, 44.

Figure 18:
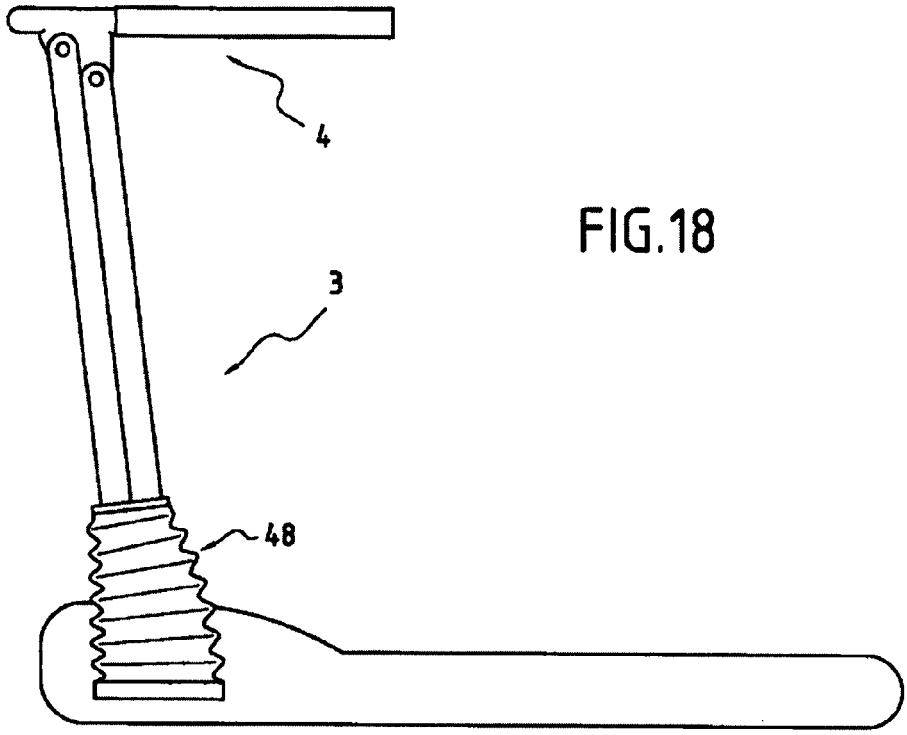
FIG. 18 is a schematic side view of an installation whose lateral uprights are equipped with a sheath and a protective boot or bellows.

FIG. 18 illustrates the implementation of a protective boot 48 that is made from a supple and flexible material, in particular an elastomer, and that forms an envelope surrounding the lower ends of the two front and rear arms, including around the articulation axes A, B, so as to protect the user against any trapping during the manipulation of the installation when folding or unfolding the device.

Figure 19:
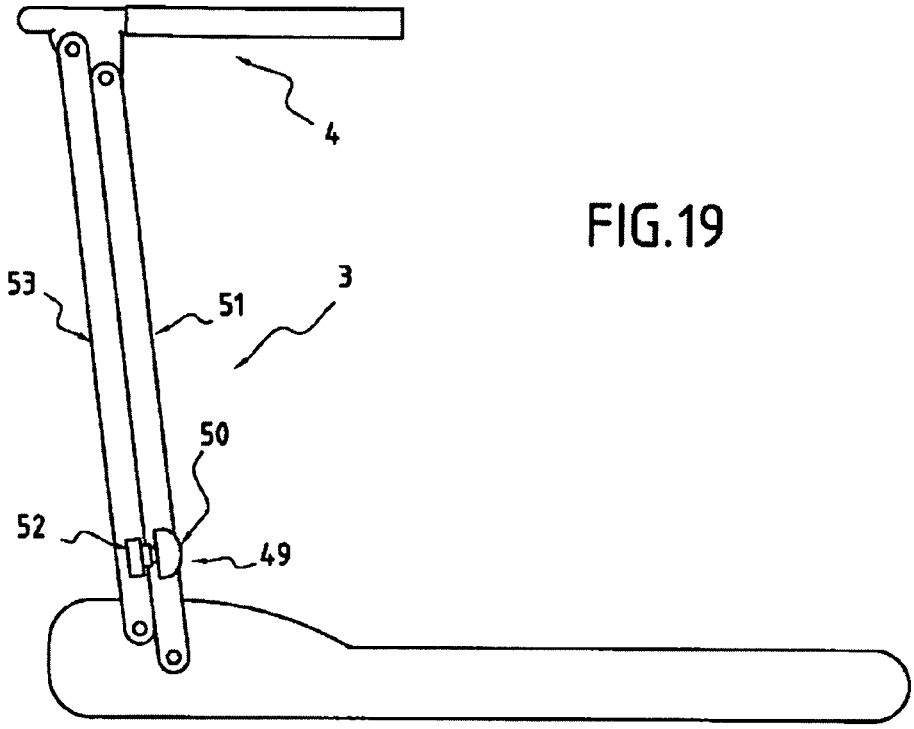
FIG. 19 is a schematic side view of an installation equipped with a sensor for detecting the position of use. The independent installation for running exercise, according to this present invention, can be folded to occupy a minimum of space.

FIG. 19 illustrates the use of a sensor 49 for detecting the position of use, with this sensor being connected to the drive motor of the running track so as to prevent the motor from running outside of the range of use of the installation. In the example illustrated, the detection sensor 49 includes a receiver 50, which is fixed onto the rear arm 51, and which is designed to bear on an end-stop 52 which itself is fixed on the front arm 53, when the two arms are in the position of use. When the receiver 50 is resting on the end-stop 52, the electrical power circuit of the motor is closed and the motor is operable. On the other hand, when the receiver 50 moves away from the end-stop 52, the electrical circuit is open, and the power feed is cut, so that the motor can no longer operable.

The independent running installation of this present invention is designed to be folded to a reduced size. This size can be such that the installation can be stored flat under a furniture item, and under a bed in particular, or indeed can be stored on edge behind a furniture item or attached up against a vertical wall. In order to ensure the stability of the installation 1, in the edgewise storage position, support feet 54, as illustrated in FIG. 1, can be placed on at least one of the sides of the platform 2. Preferably, this would be at least three support feet that together form a stable support surface when the installation is in the storage position, edgewise on the side in question.

In order to facilitate the transportation of the installation from its storage location to its site of use, it is possible to firstly position carrying handles 55, that are attached to the rear of the platform 1, for example, on either side of the running track, and secondly rollers, which are not visible in FIG. 1, and which are mounted to project from the bottom part of the face of the platform 2 that is opposite to the rollers, such as the front face of the platform for example.

This present invention is not limited to the method of implementation that has been described here by way of non-exhaustive examples. In particular the handlebar is not necessarily U-shaped. It can be designed with other configurations, in particular that may be more ergonomic.

The invention claimed is:

1. An independent and foldable running exercise installation that includes:

a) a platform that includes a running track and a device for tensioning and driving the said running track, b) two lateral uprights pivotally fixed at the front of the platform, where the top ends of these uprights support a handlebar with two handgrips, wherein:

c) the handlebar, the shape of a U, includes two lateral branches connected to each other by a linking part, with the ends of the two said lateral branches acting as handgrips, d) and each of the two lateral uprights is formed from two arms, namely a front arm and a rear arm respectively, that are close to each other in a use position, parallel and articulated by their lower ends on the side of the platform, on first and second pivoting axes and, by their top ends to the lateral branches of the handlebar on third and fourth pivoting axes, in such a manner that the four axes form a parallelogram that is deformable between a position of use in which the handgrips are more or less horizontal and the lateral uprights are generally vertical and parallel, preferably inclined toward the front of the platform, and a storage position in which the linking part of the handlebar is placed flat on the top of the platform and the lateral uprights are located on the sides of the platform.

2. The installation according to claim 1, wherein the first and the second pivoting axes are offset in height in relation to each other, the first axis being higher than the second axis.

3. The installation according to claim 1, wherein the installation includes a removable device for locking the lateral uprights at least in the position of use.

4. The installation according to claim 1, wherein, in the position of use, the rear arm of each lateral upright is resting against the front arm of the same upright, with a slope toward the front of the platform at an angle of the order of 5 to 15°, and preferably 10°.

5. The installation according to claim 1, wherein the device for temporarily locking of the lateral uprights in the first position of use include, for each lateral upright, a first locking element that is attached to a given arm and that is designed to come in contact, in a reversible manner, with the other arm, or with a second locking element attached to the other arm.

6. The installation according to claim 1, wherein the two arms of a given lateral upright are enveloped, totally or partially, by a sheath, such as a sleeve of elastic fabric, or an enclosure in a plastic material.

7. The installation according to claim 1, wherein the installation includes protective boots surrounding at least the end portions of the two lateral uprights so as to cover the area of the pivoting axes of the two front and rear arms.

8. The installation according to claim 1, wherein the installation includes a device for detecting the position of use, which is connected to the driving device of the running track and designed to enable the actuation of the driving device only when the detection device detects that the uprights are in the said position of use.

9. The installation according to claim 1, wherein the installation includes at least three support feet, on at least one side of the platform, which together form a stable base area when the installation is placed edgewise on the said side in the storage position.

10. The installation according to claim 1, wherein the installation includes carrying handles, in particular formed at the rear of the platform, and transportation rollers placed so as to project from the face of the platform opposite to the carrying handles, in particular the front face.

11. The installation according to claim 1, wherein the installation includes a control and read-out panel, mounted on the transverse portion of the handlebar with a direction such that, in the storage position, the said panel is placed flat on the top of the platform.

* * * * *

UNITED STATES PATENT AND TRADEMARK OFFICE

CERTIFICATE OF CORRECTION

PATENT NO. : 7,695,409 B2
APPLICATION NO. : 11/795414
DATED : October 26, 2007
INVENTOR(S) : Christophe Helie et al.

It is certified that error appears in the above-identified patent and that said Letters Patent is hereby corrected as shown below:

| Column | Line | |
|---|---|---|
| 2 | 49 | Change "zone of tie" to --zone of the--. |
| 5 | 13 | After "exercise" change "and n" to --and in--. |

Signed and Sealed this

Twenty-fifth Day of May, 2010

David J. Kappos

David J. Kappos
*Director of the United States Patent and Trademark Office*